US006474449B1

(12) United States Patent
Utsunomiya et al.

(10) Patent No.: US 6,474,449 B1
(45) Date of Patent: Nov. 5, 2002

(54) ELEVATOR AND GUIDE DEVICE FOR ELEVATOR

(75) Inventors: Kenji Utsunomiya, Tokyo (JP); Kenichi Okamoto, Tokyo (JP); Takashi Yumura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/691,947

(22) Filed: Oct. 20, 2000

(30) Foreign Application Priority Data

Oct. 22, 1999 (JP) ..... 11-300642

(51) Int. Cl.[7] ..... B66B 7/04
(52) U.S. Cl. ..... 187/410; 187/409; 187/292
(58) Field of Search ..... 187/409, 410, 187/292

(56) References Cited

U.S. PATENT DOCUMENTS 5,086,882 A * 2/1992 Sugahara et al. ..... 187/410
5,322,144 A 6/1994 Shalski et al.
5,439,075 A * 8/1995 Skalski et al. ..... 187/410
5,715,914 A * 2/1998 Traktovenko ..... 187/410
5,896,949 A 4/1999 Hamdy et al. ..... 187/292
5,955,709 A * 9/1999 Traktovenko et al. .. 187/410 X

FOREIGN PATENT DOCUMENTS

GB 2262932 * 7/1993 ..... 187/410
JP 5-124783 A * 5/1993 ..... 187/410
JP 6-92573 4/1994
JP B1 9-208153 8/1997

* cited by examiner

*Primary Examiner*—Christopher P. Ellis
*Assistant Examiner*—Thuy V. Tran
(74) *Attorney, Agent, or Firm*—Leydig, Voit & Mayer, Ltd.

(57) ABSTRACT

In an elevator, guide devices are attached to the elevator and include a guide lever driven in a plane; a guide element attached to the guide lever; a stationary actuator part fixed to a support member; and a moving actuator part fixed to the guide lever, wherein a first part of the moving actuator part and the stationary section is a magnet that generates a magnetic field crossing a driving direction of the moving actuator part, a second part of the moving actuator part and the stationary section is a coil wound around a bobbin which is arranged so that it is influenced by the magnetic field and drives the movable section of the actuator in the driving direction of the movable section of the actuator. The magnetic field is generated by an electric current flowing in the coil when the elevator car is vibrated.

15 Claims, 13 Drawing Sheets

ELEVATOR AND GUIDE DEVICE FOR ELEVATOR

BACKGROUND OF THE INVENTION

1. Field of the Invention

The present invention relates to an elevator and a guide device for an elevator having an actuator to reduce the vibration of a cage.

2. Description of the Related Art

In an elevator, an elevator car is guided by guide rails in such a manner that guide elements of guide devices provided in the elevator car including a cage come into contact with the guide rails vertically arranged on side walls of a hoistway. However, errors occur in the installation of the guide rails, and further deflection is caused in the guide rail by a load given to the cage, and furthermore a small level difference and winding are caused in the guide rail by the change with age. Therefore, when the cage of the elevator car is run, it is affected by an external disturbance caused by the level difference and winding of the guide rail. Accordingly, the cage is vibrated in the up and down direction (elevating direction) and the side to side direction (direction perpendicular to the elevating direction). As a result, passengers feel uncomfortable.

Conventionally, in order to reduce the longitudinal and the lateral vibration, an elastically supporting member or a vibration isolating member for reducing an input of displacement given by the guide rail is arranged between the cage and the car frame or between the car frame and the guide element. In order to provide a great effect of isolation of vibration, it is necessary to reduce the rigidity of the elastically supporting member and the vibration isolating member. On the other hand, in order to prevent the occurrence of interference of the cage with other components when an imbalance load is given to the cage, it is necessary to somewhat increase the rigidity. For the above reasons, it is difficult to design an elevator by which a sufficiently high vibration isolating effect can be provided and at the same time no problems are caused even if an imbalanced load is given to the cage.

Accordingly, when the elastically supporting member or the vibration isolating member, by which an input of displacement given to the cage is only passively reduced, is provided, it is impossible to solve the problems caused when the elevating speed of an elevator is increased.

Therefore, attention is given to an active vibration isolating method, in which a force to suppress vibration is given from the outside, instead of the passive vibration isolating method. Especially, there is proposed an active vibration isolating method in which an electric current is made to flow in a coil so as to generate a magnetic field at the center (axial center) of the coil, and vibration is reduced by a magnetic force when a reaction bar made of magnetic body is arranged at a position opposed to the magnetic field.

FIG. 13 is a cross-sectional view showing an example of an elevator device to which the above active vibration isolating method is applied, which is described in Japanese Unexamined Patent Publication No. 6-92573.

As shown in FIG. 13, there is provided a car frame 101 for supporting a cage, and a support base 102 is fixed to the car frame 101. A support arm 103 extending in the vertical direction (elevating direction) is pivotally attached to this support base 102. In this support arm 103, there is provided a roller 105 that rotates coming into contact with a rail 104 vertically arranged on a side wall of a hoistway. An arm 106 (reaction bar) extending in the horizontal direction is pivotally attached to the support base 102, and this arm 106 is connected with the support arm 103. Due to the above structure, when the arm 106 is driven, the support arm 103 is driven.

In the car frame 101 under the arm 106, there is provided an electromagnetic induction member 107 round which a coil is wound. This electromagnetic induction member 107 round which a coil is wound composes a stationary section of an actuator. On the other hand, the arm 106 located above this electromagnetic induction member 107 is made of magnetic substance. This arm 106 (reaction bar) composes an movable section of the actuator.

In order to suppress the occurrence of vibration of the cage, an electric current is made to flow in the coil so as to generate a magnetic field in the electromagnetic induction member 107 in the vertical direction. The arm 106 is attracted by a magnetic force generated by this magnetic field in the vertical direction. As a result, the support arm 103 is driven, so that an intensity of the exciting force transmitted to the car frame 101 can be reduced. In this connection, at this time, a magnetic field in the vertical direction is generated by the electromagnetic induction member 107, that is, a magnetic field is generated on the moving plane of the arm 106.

Due to the above structure of the conventional elevator, a positional relation between the movable section and the stationary section of the actuator is changed by a static displacement by which the cage is tilted by an imbalance load and also by a dynamic displacement by which a position of the movable section of the actuator is changed by the drive of the actuator. Therefore, compared with a case in which the static and the dynamic displacement are not caused, a magnetic force given to the movable and the stationary section of the actuator is changed.

Accordingly, the magnetic force generated in the case of the static displacement and the magnetic force generated in the case of the dynamic displacement are different from each other. However, when the actuator is controlled, a control method is adopted which is suitable for a case in which no displacements are caused. Therefore, it is impossible to conduct an appropriate control. As a result, a drive force of the actuator can not act properly. It can be considered to adopt a method in which it is judged whether the static displacement and the dynamic displacement exist or not. However, when the above method is adopted, it is necessary to conduct a complicated and difficult control.

SUMMARY OF THE INVENTION

The present invention has been accomplished to solve the above problems. It is an object of the present invention to provide an elevator and a guide device of the elevator provided with an actuator characterized in that: a drive force to drive the actuator acts properly even when the static and the dynamic displacement are caused so that a sufficiently high vibration isolating effect can be provided.

The present invention provides an elevator comprising: an elevator car including a cage which runs in a hoistway along a pair of rails vertically arranged on side walls in the hoistway; and a plurality of guide devices for guiding the elevator car along with the pair of rails, attached onto the rail sides of the elevator car, each guide device including: a guide lever pivotally attached to a support member fixed to the elevator car or pivotally attached to the elevator car, so that the guide lever can be driven on a moving plane; a guide element for guiding the elevator car along the rail, being attached to the guide lever and coming into contact with the rail vertically arranged on the side wall of the hoistway; and an actuator device having a stationary actuator part fixed to the support member or the elevating member and also having a moving actuator part fixed to the guide lever and driven on the moving plane, wherein one of the moving actuator part and the stationary actuator part is a magnet for generating a magnetic field crossing a drive direction of the moving actuator part, the other of the moving actuator part and the stationary actuator part is a coil arranged so that the coil can be influenced by the magnetic field, and a Lorentz's force for driving the moving actuator part in the drive direction of the moving actuator part is generated by supplying an electric current in the coil when the elevator car is vibrating, so that the guide lever is driven by the Lorentz's force so as to suppress the vibration of the elevator car.

The magnet is arranged so that it can generate a magnetic field in a direction crossing the moving plane of the guide lever.

The magnet is arranged so that it can generate a magnetic field in a direction perpendicular to the moving plane of the guide lever, and the central axis of the coil is included on the moving plane of the guide lever.

The guide lever is driven in a predetermined region on the moving plane, and an area in which the coil and the magnetic field cross each other becomes constant with respect to the drive of the guide lever in the predetermined region.

The magnet is arranged so that it can cover a region in which the coil is moved when the guide lever is driven.

The magnet is composed of a pair of magnets arranged being opposed to each other with respect to the moving plane of the moving actuator part, a yoke member located at a predetermined distance from each magnet is arranged between the pair of magnets, and the coil is arranged in such a manner that the coil surrounds the yoke member so that the yoke member and the coil can not be contacted with each other when the moving actuator part is driven.

A guide device for an elevator of the present invention comprises: a guide lever attached to a support member fixed to an elevator car including a cage which runs in a hoistway along a pair of rails vertically arranged on side walls in the hoistway, the guide lever being driven on a moving plane; a guide element for guiding the elevator car along the rail, being attached to the guide lever and coming into contact with the rail vertically arranged on the side wall of the hoistway; and an actuator device having a stationary actuator part fixed to the support member and also having a moving actuator part fixed to the guide lever and driven on the moving plane, wherein one of the moving actuator part and the stationary actuator part is a magnet for generating a magnetic field crossing a drive direction of the moving actuator part, the other of the moving actuator part and the stationary actuator part is a coil arranged so that the coil can be influenced by the magnetic field, and a Lorentz's force for driving the moving actuator part in the drive direction of the moving actuator part is generated by supplying an electric current in the coil when the elevator car is vibrating, so that the guide lever is driven by the Lorentz's force so as to suppress the vibration of the elevator car.

The magnet is arranged so that it can generate a magnetic field in a direction crossing the moving plane of the guide lever.

The guide lever is driven in a predetermined region on the moving plane, and an area in which the coil and the magnetic field cross each other becomes constant with respect to the drive of the guide lever in the predetermined region.

DETAILED DESCRIPTION OF THE PRESENT INVENTION

Embodiment 1

Figure 1:
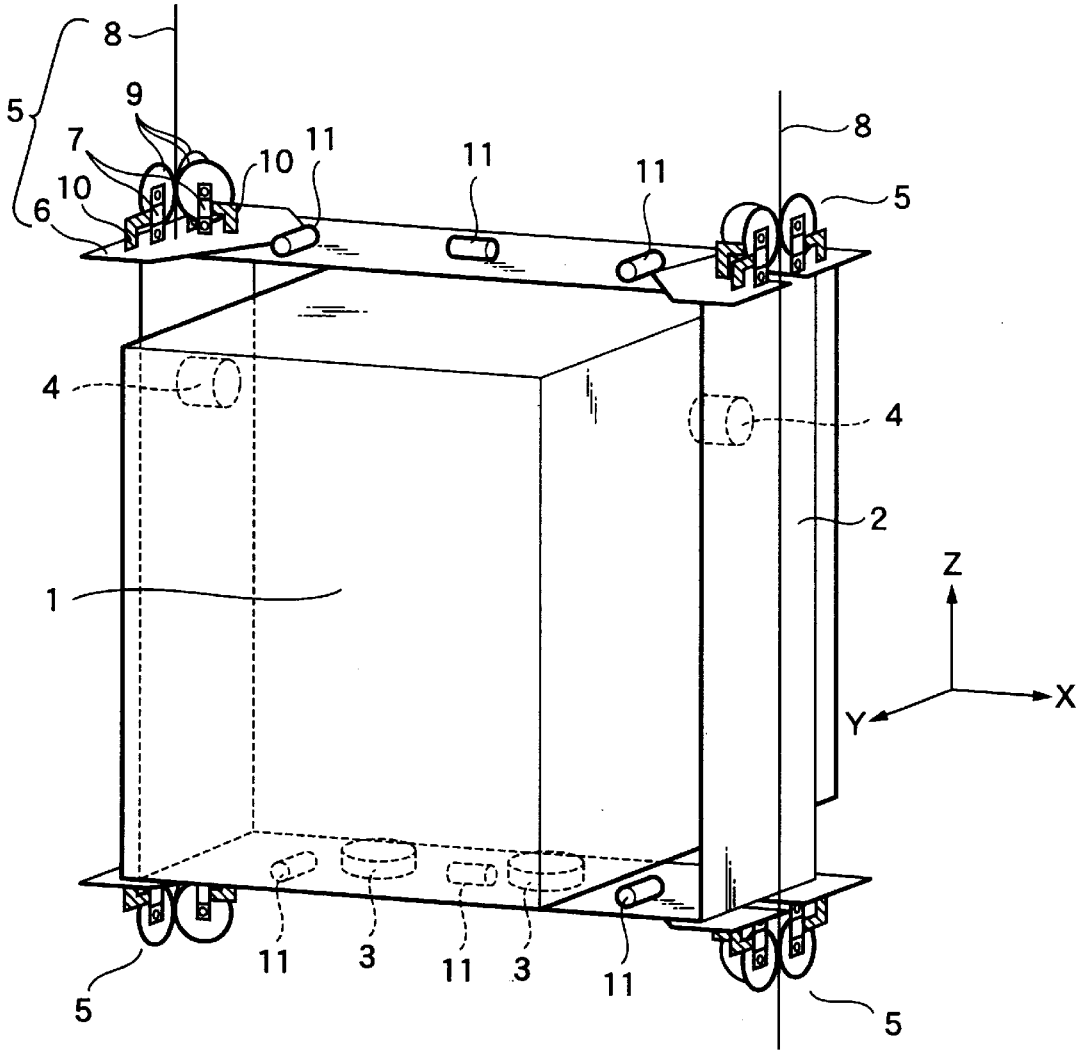
FIG. 1 is an overall arrangement cross-sectional view showing an outline of an elevator of Embodiment 1 of the present invention.

FIG. 1 is an overall arrangement view showing an outline of an example of the elevator of Embodiment 1 of the invention. In the drawing, reference numeral 1 is a cage, and reference numeral 2 is a car frame for elastically supporting the cage 1 via a vibration isolating rubber 3 and a cage support steadying clamp 4. The cage 1 and car frame 2 compose an elevator car.

Reference numeral 5 represents guide devices which are respectively attached to the right and left of the upper and the lower frame of the car frame 2. Each guide device primarily includes: a support base 6 fixed to the car frame 2; a guide lever 7 pivotally attached to this support base 6; a roller 9 attached to the guide lever 7, which is a guide element to be engaged with a guide rail 8 vertically arranged on a side wall of a hoistway; and an actuator 10 for actively controlling the drive of the guide lever 7 so that the contact of the guide rail 8 with the roller 9 can be properly adjusted.

Reference numeral 11 represents inertial sensors which are respectively attached to the upper and the lower frame of the car frame 2. These inertial sensors respectively detect accelerations in the X and the Y direction of the car frame 2, so that the vibrating conditions of the cage 2 in the X and the Y direction can be detected. In this embodiment, the inertial sensors detect the vibrating conditions of the cage 2 in the X and the Y direction, however, the present invention is not limited to the above specific embodiment, but it is sufficient that the inertial sensors can detect the vibrating conditions of two different directions on the plane of X and Y. Reference numeral 12 (shown in FIG. 5) is a controller (not shown in FIG. 1) for converting an output signal of the inertial sensor 11 into a drive signal for driving the actuator 10.

In this connection, as shown in FIG. 1, the elevating direction of the elevator car is defined as direction Z, wherein the rising direction is positive and the descending direction is negative, and the side to side direction (the elevator door opening and closing direction), which is perpendicular to the elevating direction, is defined as. direction X, and the front to back direction (the direction perpendicular to the side to side direction) is defined as direction Y.

Next, the guide device 5 shown in FIG. 1 will be explained in detail.

Figure 2:
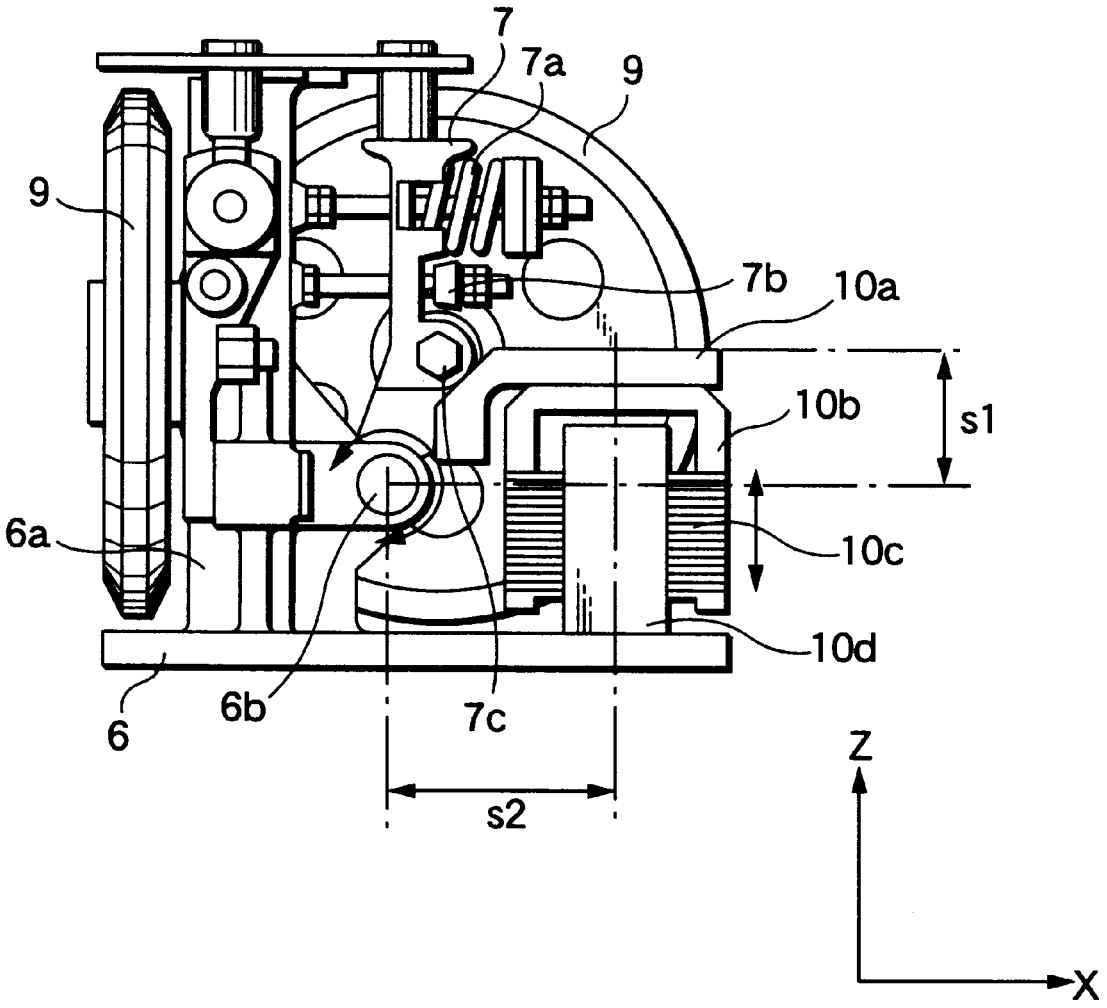
FIG. 2 is a side view showing a guide device of the elevator shown in FIG. 1.
Figure 3A:
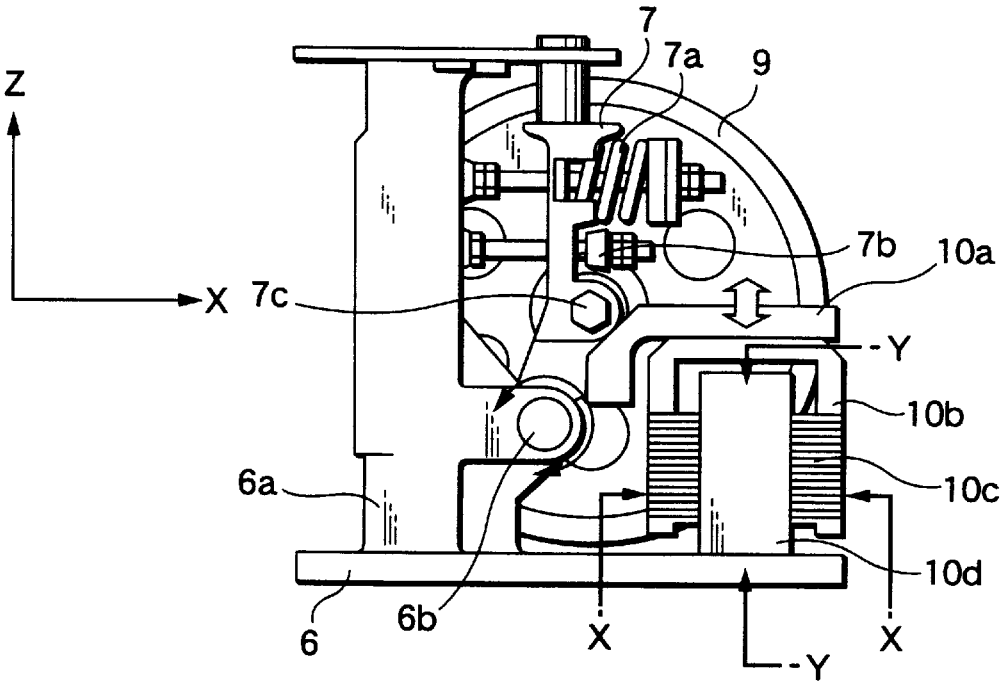
FIGS. 3A and 3B are side view showing an outline of the guide device shown in FIG. 2.
Figure 3B:
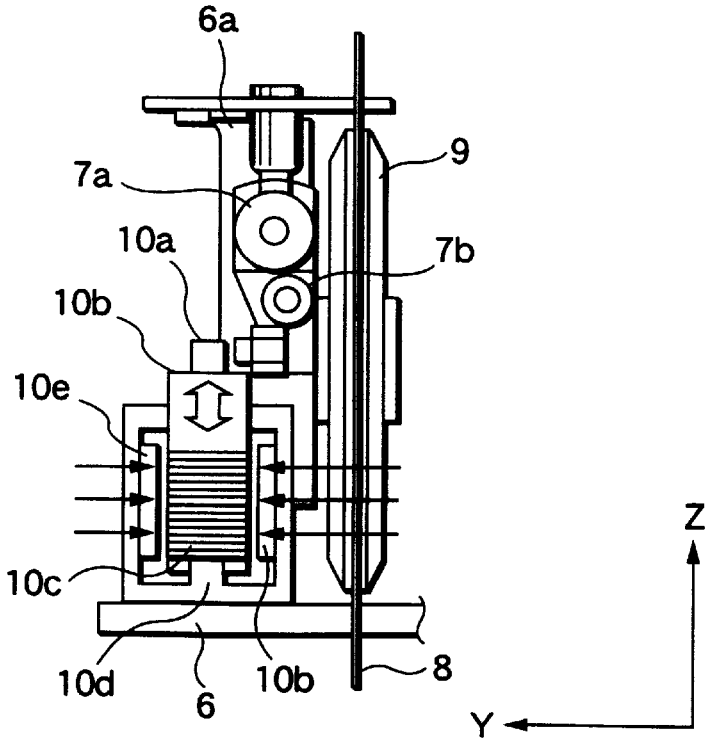
Figure 4A:
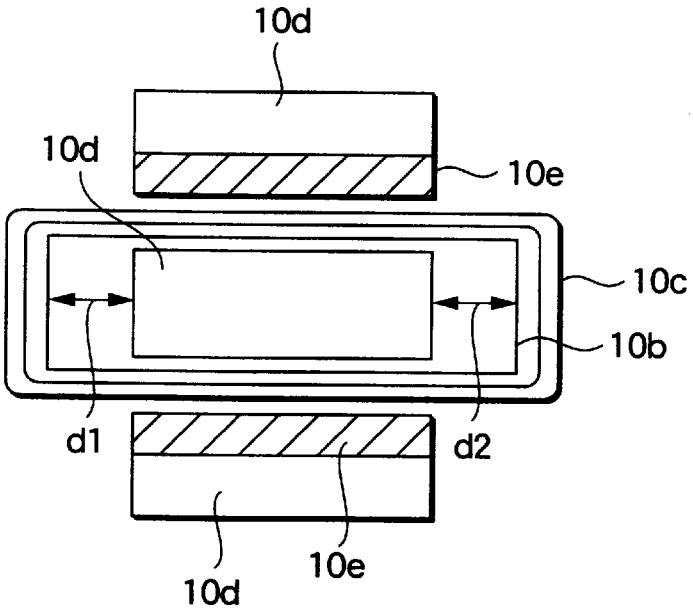
FIGS. 4A and 4B are cross-sectional views of the actuator shown in FIG. 2.
Figure 4B:
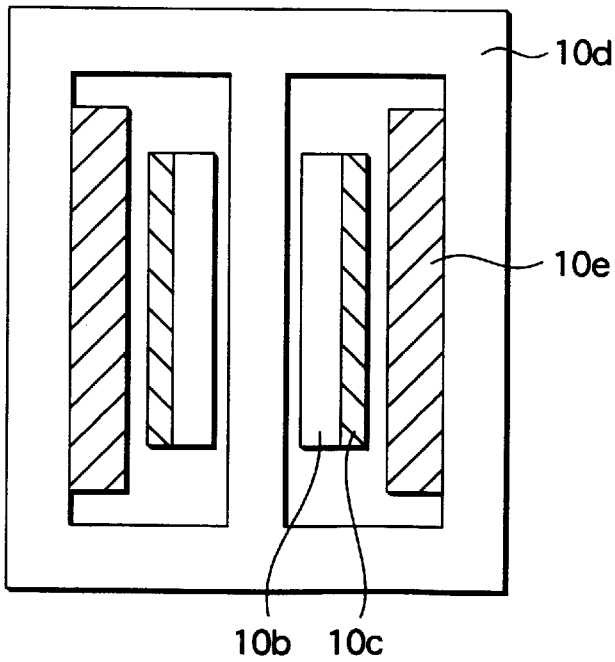

FIG. 2 is a side view showing the guide device illustrated in FIG. 1. FIGS. 3A and 3B are side views in which only the guide lever (roller) for driving on the plane of X and Z is drawn and other guide levers (rollers) shown in FIG. 2 are omitted so that the explanation can be made simple. FIG. 3A is a side view showing a side opposite to the side on which the roller is attached, that is, FIG. 3A is a side view taken from the positive side in direction Y. FIG. 3B is a side view showing a side on which the actuator is provided and which is an opposite side to the rail, that is, FIG. 3B is a side view taken from the positive side in direction X. FIGS. 4A and 4B are cross-sectional views showing an actuator shown in FIGS. 3A and 3B. FIG. 4A is a cross-sectional view taken on line X—X in FIGS. 3A and 3B, and FIG. 4B is a cross-sectional view taken on line Y—Y in FIGS. 3A and 3B.

In the drawing, reference numeral 6 is a support base strongly fixed to the car frame 2, reference numeral 6*a* is a guide lever fixing member extending from the support base 6 in the positive direction of the elevating direction, and reference numeral 7 is a guide lever pivotally attached to the guide lever fixing member 6*a*. When the guide lever 7 is pivotally attached to the guide lever support point 6*b*, the guide lever 7 is driven in a moving plane (plane XZ in this case). In this connection, this guide lever 7 is provided with a spring element 7*a* and a stopper 7*b*. Reference numeral 9 is a roller rotatably attached to the guide lever 7 when it is pivotally attached to the roller support point 7*c* of guide lever 7.

Reference numeral 10*a* is an arm fixed to the guide lever 7 and extending from the guide lever 7 in the horizontal direction, reference numeral 10*b* is bobbin fixed on the lower side of the arm 10*a*, and reference numeral 10*c* is a coil wound round the bobbin 10*b*. These arm 10*a*, bobbin 10*b* and coil 10*c* compose a movable section of the actuator 10 for the guide lever of the guide device.

Reference numeral 10*d* is a yoke fixed to the support base 6. As shown in FIGS. 3B, 4A and 4B, in this yoke 10*d*, two magnets 10*e* are arranged being opposed to each other. Between these magnets 10*e*, the yoke 10*d* is arranged while a predetermined distance is kept from the yoke 10*d* to the magnets 10*e*. These yoke 10*d* and magnets 10*e* compose a stationary section of the actuator 10 for the guide lever of the guide device.

In this case, as shown in FIGS. 2, 3A and 3B, the magnet 10*e* is arranged so that it can generate a magnetic field in a direction (direction Y) perpendicular to the moving plane (plane XZ) of the guide lever 7, and the coil 10*c* is arranged so that the axial center of the coil is in the perpendicular direction to the magnetic field. It is sufficient that the direction of this magnetic field crosses the moving plane of the guide lever 7, however, it is preferable that the direction of this magnetic field is perpendicular to the moving plane. The reason is that when the direction of this magnetic field is perpendicular to the moving plane, intensities of the magnetic field passing through the coil become equal at all positions. Therefore, control can be stably performed.

Since the movable section of the actuator 10 is oscillated, the control force generating axis of the actuator 10 and the central axis of the stationary section of the actuator 10 are not always parallel to each other, that is, the central axis of the coil 10*c* wound round the bobbin 10*b* and the central axis of the stationary section of the actuator 10 are not always parallel to each other. Occurrence of this phenomenon can not be avoided as long as the guide roller 9 is supported at the support point 7*c* and oscillated.

Therefore, the actuator 10 is preferably composed as shown in FIG. 4A. Intervals d1 and d2 between the coil 10*c* wound round the bobbin 10*b* on the guide lever moving plane and the face (exposed face) of the yoke 10*d* arranged in the coil 10*c* are preferably extended. Intervals between the yoke 10*d* on the moving plane of the guide lever and the coil 10*c* wound round the bobbin 10*b*, that is, d1 and d2 shown in FIG. 4A are determined so that the minimum clearances (e1, e2, e3 and e4) between the coil 10*c* wound round the bobbin 10*b* and the yoke 10*d*, which are caused by a shift of the central axis, can be larger than the safe clearance $\epsilon$. The minimum clearances (e1, e2, e3 and e4) are shown in FIG. 7B.

That is, the arrangement is determined so that the clearances d1 and 2 can satisfy the following inequality.

(Clearances d1, d2)>(Static displacement caused by imbalance load)+(Dynamic displacement in the case of drive)

Due to the above arrangement, a stroke of the outside coil 10*c* on the moving plane can be extended in the above rotary mechanism. Therefore, even when a static displacement is caused by an imbalance load given to the cage and an equilibrium point of the coil 10*c*, which is a movable section of the actuator, is changed, it is possible to ensure a sufficiently long stroke. Accordingly, there is no possibility that the movable section (the coil 10*c* wound round the bobbin 10*b* ) of the actuator and the stationary section (the yoke 10*d* ) of the actuator come into contact with each other.

In this case, the direction of magnetic flux is perpendicular to the arm moving plane. Accordingly, even if the clearances d1 and d2 are increased, the force constant of the actuator is not changed. Therefore, the stroke of the movable section of the actuator can be sufficiently extended without changing the force constant of the actuator.

Figure 5:
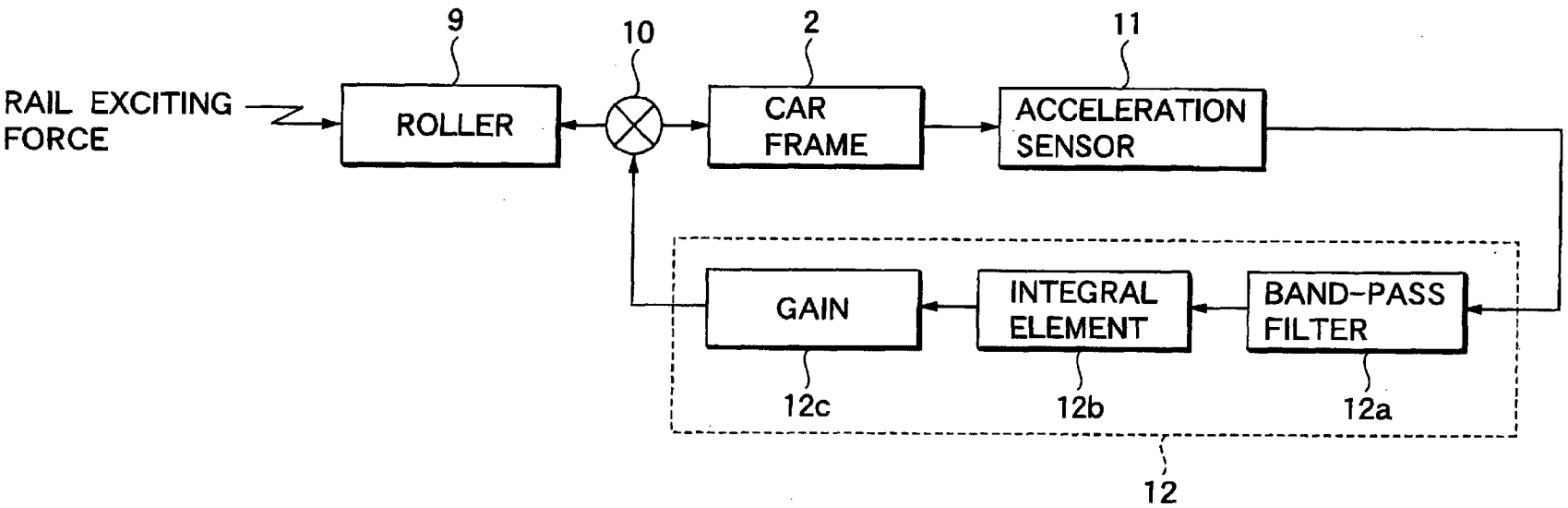
FIG. 5 is a block diagram showing a method of operation control of the elevator shown in FIG. 1.
Figure 6:
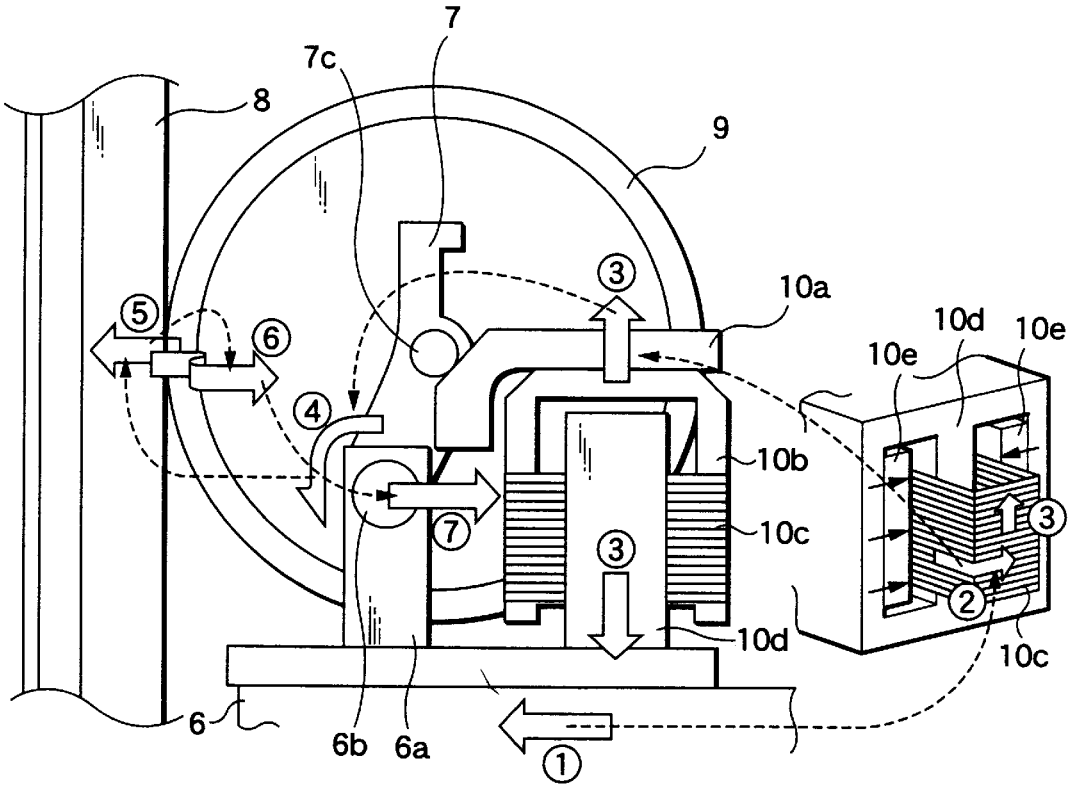
FIG. 6 is a schematic illustration for explaining operation of the guide device of the elevator shown in FIG. 1.

The motion of the elevator shown in FIG. 1 will be explained below. In this connection, all the motion of this embodiment is the same as that of the conventional example except for suppressing the vibration of the cage by the actuator. Therefore, only the motion of the actuator will be explained here. FIG. 5 is a block diagram for explaining the operation control method of the elevator shown in FIG. 1. FIG. 6 is a schematic illustration for explaining the motion of the guide device of the elevator shown in FIG. 1.

As shown in FIG. 5, when the car frame 2 is vibrated, the inertial sensor 11 attached to the car frame 2 detects the acceleration caused by this vibration as an acceleration signal and inputs it into the controller 12. In the controller 12, this inputted signal is inputted into the band-pass filter 12*a*, so that the frequencies unnecessary for control (for example, DC-like vibration components) are removed by the band-pass filter 12*a*, and this signal is converted into an abslute velocity signal by the integral component 12*b*. For example, this abslute velocity signal is a velocity signal, the frequency component of which is 0.1 to 20 Hz. This signal is sent to the actuator 10 of the guide device 5 via the gain adjusting device 12*c*, and the actuator 10 is controlled according to this velocity signal so that a contact state of the roller 9 with the rail 8 can be adjusted.

When the low frequency components in the acceleration signal are filtered away by the band-pass filter in this way, a gravity component caused by a tilt of the car frame 2 contained in the acceleration signal can be removed, and also a bias error of the output of the accelerometer can be removed. Therefore, generation of the absolute speed error can be prevented by the integral component.

Although it is difficult for a man to feel DC-like vibration components, the actuator 10 is given a heavy load by the DC-like vibration components. Therefore when the DC-like vibration components of the acceleration signal are filtered away, the maximum drive force required for the actuator 10 can be reduced while the passenger do not feel uncomfortable when he rides the elevator. However, these low frequency components may not be cut off but they may be extracted by a low pass filter and used as information of a static tilt of the cage.

When the high frequency components are filtered from the output of the inertial sensor 11 by the band-pass filter, it is possible to prevent the control from becoming unstable when the vibration mode of high order of the elevator is excited.

In this connection, the pass band of 0.1 to 20 Hz of the band-pass filter is determined when a sufficient consideration is given to the primary lateral vibration frequency of the elevator and the frequency mostly felt by a man. As long as the condition is satisfied, the frequency is not necessarily limited to 0.1 to 20 Hz.

Next, the motion of the actuator will be explained below.

For example, as shown in FIG. 6, when an absolute speed of the car frame 2 is generated in the direction of arrow (1) shown in FIG. 6, the controller 12 gives a command to the coil 10*c* so that an electric current can be made to flow in the direction of arrow (2). According to this command, the electric current is made to flow in the coil 10*c* in the direction of arrow (2). In this case, a magnetic flux is generated around the coil 10*c* by the permanent magnet 10*e* arranged in the yoke 10*d* in the direction of arrows (in the direction from the magnet 10*e* to the coil 10*c* ). Therefore, Lorentz's force is generated in the coil 10*c* in the direction of arrow (3) by Fleming's left hand rule.

The thus generated Lorentz's force in the direction of arrow (3) generated in the coil 10*c* is converted into torque in the direction of arrow (4) which acts round the guide lever support point 6*b*, and the guide roller 9 is pressed against the guide rail 8 in the direction of arrow (5). At this time, the guide roller 9 is given a reaction force in the direction of arrow (6) by the guide rail 8. This reaction force is transmitted from the guide lever support point 6*b*, and a force in the direction of arrow (7) is generated in the support base 6 and the car frame 2.

Accordingly, in the car frame 2, a force is generated, the intensity of which is proportional to the absolute speed of the cage and the direction of which is reverse to the absolute speed. Therefore, the car frame 2 behaves as if a damper were provided between the car frame 2 and the absolute space. As a result, vibration of the car frame 2 can be greatly reduced, that is, vibration of the cage can be greatly reduced.

Next, explanations will be made into a relation between the coil and the magnetic field in the case of driving the guide lever.

Figure 7A:
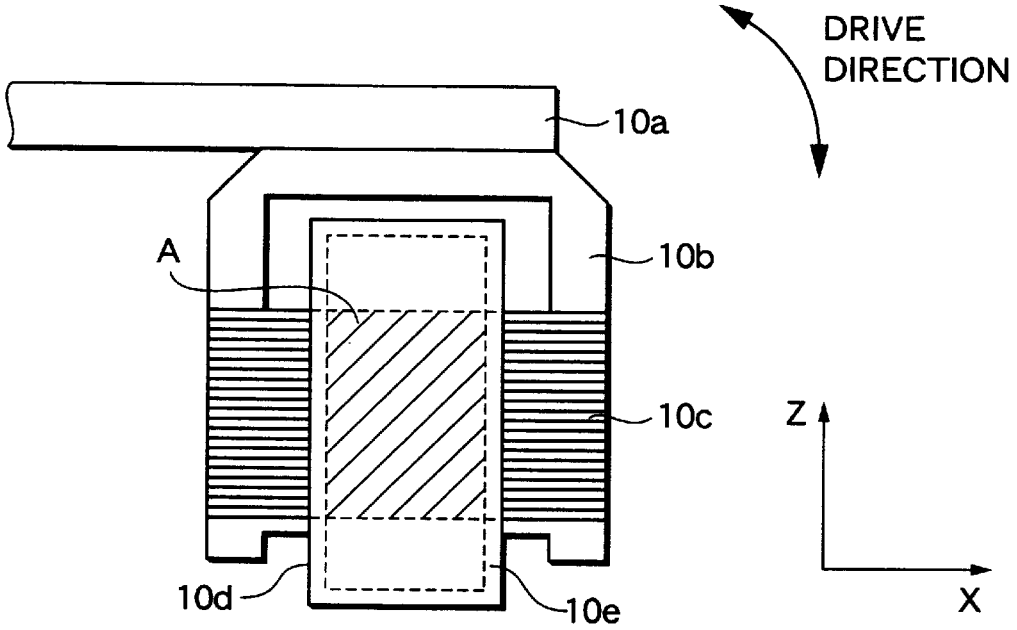
FIGS. 7A and 7B are views for explaining a relation between the coil and the magnetic field in the case of driving a guide lever.
Figure 7B:
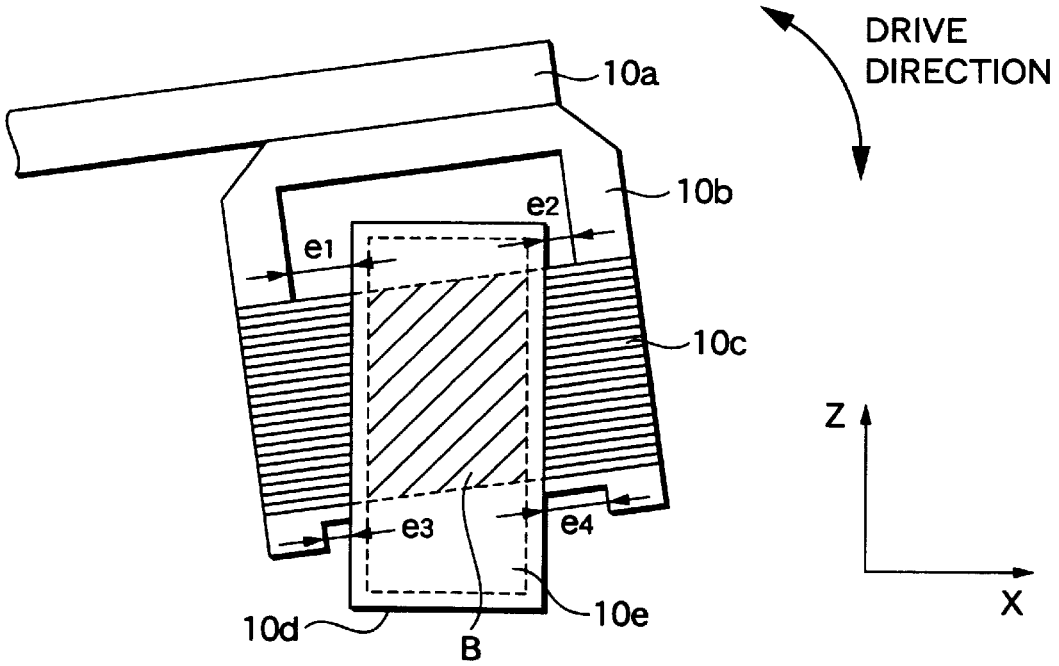

FIGS. 7A and 7B are views for explaining a relation between the coil and the magnetic field in the case of driving the guide lever. FIG. 7A is a view showing a state in which the direction of the central axis of the coil 10*c* is in the direction of Z-axis. FIG. 7B is a view showing a state in which the direction of the central axis of the coil 10*c* is tilted in the direction of the negative side of X-axis with respect to Z-axis.

As shown in FIG. 7A, when the direction of the central axis of the coil 10*c* is in the direction of Z-axis, a region of the coil 10*c* which receives the magnetic field of the magnet 10*e* is region A shown in FIG. 7A. On the other hand, as shown in FIG. 7B, when the arm 10*a* is driven and the direction of the central axis of the coil 10*c* is tilted to the negative side of X-axis with respect to Z-axis, a region of the coil 10*c* which receives the magnetic field of the magnet 10*e* is region B shown in FIG. 7B. The profile of region B is different from the profile of region A, however, the area of region B is substantially the same as the area of region A.

In this embodiment, the length of the coil in the axial direction is smaller than the width of the magnet. Therefore, even if the position of the coil 10*c* is changed by a static displacement caused by an unbalance load and also changed by a dynamic displacement in the case of driving, the area of the magnetic field of the magnet 10*e* received by the coil 10*c* is seldom changed, and an intensity of the electric current crossing the magnetic field can be kept substantially constant irrespective of the position of the guide lever.

In the arrangement shown in FIGS. 2, 3A and 3B, the following relation is established, wherein $f_a$ is a force generated in the actuator 10, and $f_r$ is a pushing force given from the roller 9 to the guide rail 8, that is, $f_r$ is a force generated in the car frame 2.

$$f_r=(S2/S1)f_a \tag{1}$$

In the above equation, S1 is a distance in the vertical direction from the guide lever support point 6*b* to the rotational center 7*c* of the guide roller, and S2 is a distance from the guide lever support point 6*b* to the actuator force generating axis (shown in FIG. 2).

In this case, when S2 is made larger than S1, it is possible to generate a high damping force with respect to a low actuator generating force. Accordingly, when the length of the arm 10*a* is extended, it is possible to reduce an intensity of the force necessary for the actuator 10. Therefore, the weight and the cost can be further reduced.

In the structure of the actuator shown in FIGS. 2, 3A and 3B in which a force in the vertical direction is converted into a force in the horizontal direction, even if the length of the arm 10*a* is extended, the height in the vertical direction is not changed, which is very advantageous in the elevator system in which the height of the hoistway is restricted.

In this embodiment, each guide device is provided with three actuators, and a pair of guide devices are arranged on the right and left in the upper portion of the car frame, and also a pair of guide devices are arranged on the right and left in the lower portion of the car frame. However, it should be noted that the invention is not limited to the above specific embodiment. As long as vibration of the elevator car can be sufficiently reduced, the number of the actuators may be decreased.

In this embodiment, the guide device is attached to the car frame, however, in the case of an elevator having only a cage and not having a car frame, the guide device may be directly attached to the cage.

In this embodiment, the acceleration is detected so as to detect the vibrating state. However, the present invention is not limited to the above specific embodiment in which the acceleration is detected, for example, the speed may be detected.

In this embodiment, explanations are made into the roller type elevator, the guide element of which is composed of a roller, however, the guide element is not necessarily composed of a roller, for example, the guide element may be composed of a slide shoe having an engaging piece.

In this embodiment, explanations are made into a case in which the speed feedback method, which is well known as an active control method, is used. However, the control method is not limited to the speed feedback method, for example, acceleration may be used for control.

In this embodiment, vibration of the elevator car is detected by inertial sensors. However, a current detector for detecting an electric current flowing in the coil may be provided so that vibration of the elevator car may be judged by an electric current flowing in the coil. When the elevator car is vibrated, the coil in the movable section of the actuator is moved with respect to the magnet in the stationary section of the actuator. Therefore, the coil is moved in the magnetic flux by the vibration of the elevator car. Accordingly, a counter electromotive force is generated in the coil. Therefore, when an electric current flowing in the coil is detected, vibration of the elevator car can be detected.

In the elevator of this embodiment, the magnet to generate a magnetic field in the direction crossing the drive direction of the movable section of the actuator of the guide device is fixed to the elevator car, the guide lever is attached to the coil so that the coil can be affected by this magnetic field, Lorentz's force to drive the guide lever is generated in the coil when an electric current is made to flow in the coil, and the guide lever is driven by this Lorentz's force. Accordingly, it is possible to generate a force, the direction of which is perpendicular to the direction of the magnetic field. Therefore, it is possible to provide an actuator of a simple structure, the force constant of which is seldom changed even if a static displacement or a dynamic displacement is generated. In this case, the force constant is defined as a ratio of an electric current, which is made to flow in the coil, to a generated force.

Further, the magnet is arranged so that a magnetic field can be generated in the direction crossing the drive face of the guide lever. Therefore, even when a static displacement is caused by an imbalance load given to the cage and also even when a dynamic displacement is caused in the case of driving the elevator, since a distance between the magnet, which is a stationary section of the actuator, and the coil, which is a movable section of the actuator, is not changed, an intensity of the magnetic field formed around the coil becomes substantially constant. Therefore, even when a static displacement or a dynamic displacement is caused, the substantially same vibration reducing capacity as that of a case in which a static displacement or a dynamic displacement is not caused can be provided, and further control of the actuator can be easily performed.

With respect to all the drive region of the guide lever, an area in which the coil and the magnetic field cross each other is made constant. Therefore, when the guide lever is driven, a force given to the coil by the magnetic field can be made constant. Accordingly, even when a static displacement is caused by an imbalance load given to the cage and also even when a dynamic displacement is caused in the case of driving the elevator, an intensity of the magnetic field formed around the coil becomes substantially constant. Therefore, even when a static displacement or a dynamic displacement is caused, the substantially same vibration reducing capacity as that of a case in which a static displacement or a dynamic displacement is not caused can be provided, and further control of the actuator can be easily performed.

Lorentz's force is generated in the elevating direction of the elevator car so that a force in the elevating direction can be converted into a force in the horizontal direction. Therefore, it is possible to extend the length of the arm 10*a* without changing the height of the actuator in the vertical direction, that is, it is possible to increase an intensity of the actuator force without changing the height of the actuator in the vertical direction.

Embodiment 2

In Embodiment 1, the movable section of the actuator is composed of a coil, and the stationary section of the actuator is composed of a magnet. On the other hand, in Embodiment 2, the stationary section of the actuator is composed of a coil, and the movable section of the actuator is composed of a magnet.

Figure 8A:
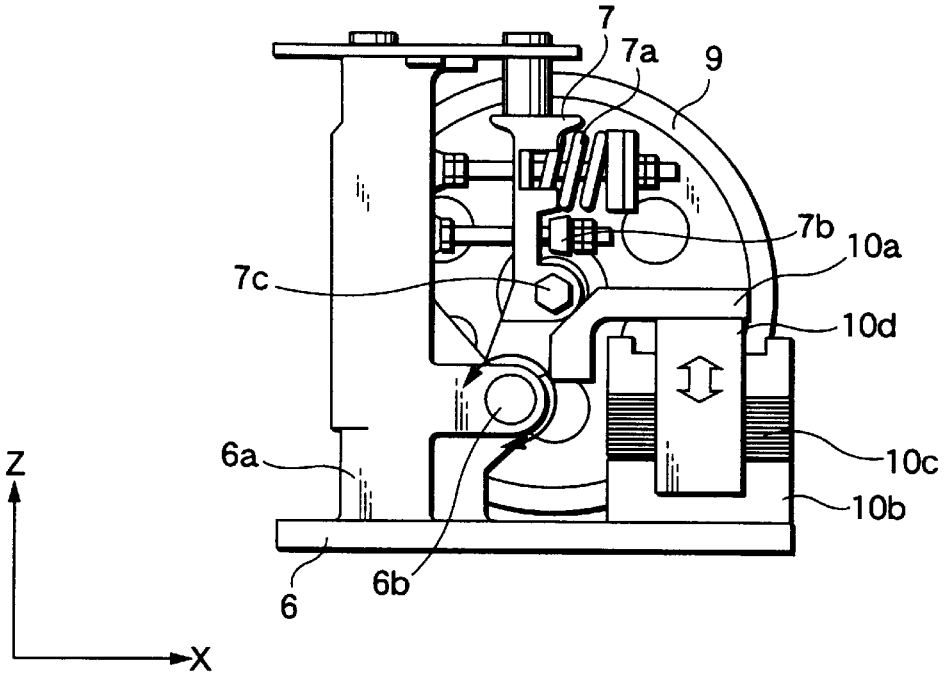
FIGS. 8A and 8B are overall arrangement side views showing an outline of a guide device of an elevator of Embodiment 2 of the present invention.
Figure 8B:
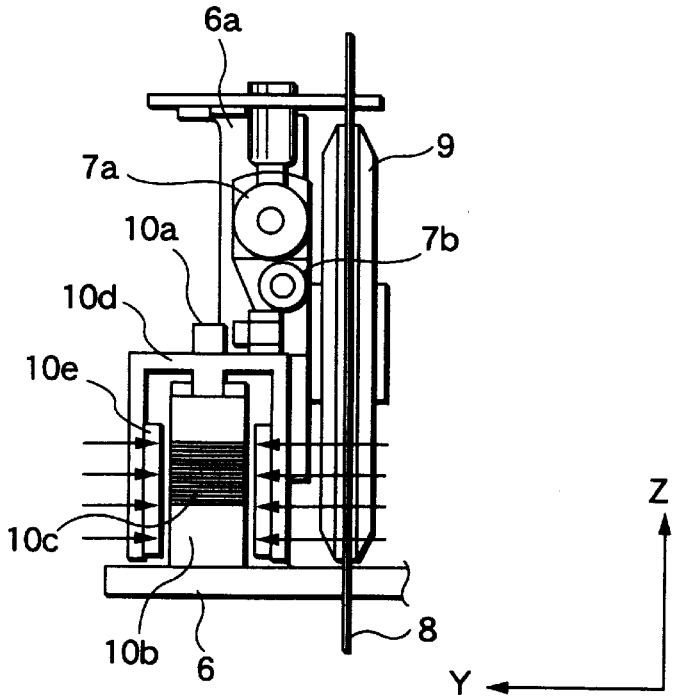

FIGS. 8A and 8B are side views showing a guide device of an elevator of this embodiment, FIG. 8A is a side view showing an opposite side to a roller, that is, FIG. 8A is a side view taken from the positive side of direction Y, and FIG. 8B is a side view showing an opposite side to a rail, that is, FIG. 8B is a side view showing a side on which an actuator is provided, that is, FIG. 8B is a side view taken from the positive side of direction X. In the drawing, reference numeral 10*a* is an arm fixed to the guide lever 7 and extending from the guide lever 7 in the horizontal direction. Reference numeral 10*d* is a yoke fixed onto the lower side of the arm. In this yoke, there are provided two magnets 10*e* which are opposed to each other. That is, the yoke 10*d* is arranged between the two magnets 10*e* leaving a predetermined distance. These arm 10*a*, yoke 10*d* and magnets 10*e* compose a movable section of the actuator 10 for the guide lever of the guide device 5.

Reference numeral 10*b* is a bobbin fixed to the support base 6, and reference numeral 10*c* is a coil wound round the bobbin 10*b*. These bobbin 10*b* and coil 10*c* compose a stationary section of the actuator 10 for the guide lever of the guide device.

In this case, in the same manner as that of Embodiment 1, the magnet 10*e* is arranged so that it can generate a magnetic field in a direction (direction Y) perpendicular to the moving plane (plane XZ) of the guide lever 7, and the coil 10*c* is arranged so that the axial center of the coil is in the perpendicular direction to the magnetic field. Also, in Embodiment 2, a relation between the coil 10*c* and the yoke 10*d* arranged in the coil 10*c* is the same as that of Embodiment 1.

In the elevator of this embodiment, the magnet generating a magnetic field which crosses the moving plane of the guide lever of the guide device is fixed to the guide lever of the guide device, and the coil is attached to the elevator car so that the coil can be affected by this magnetic field, so that a force to drive the guide lever can be generated when an electric current is made to flow in the coil. Accordingly, even when a static displacement is caused by an imbalance load given to the cage and also even when a dynamic displacement is caused in the case of driving the elevator, a distance between the coil, which is a stationary section of the actuator, and the magnet, which is a movable section of the actuator, is not changed. Therefore, intensities of the magnetic field around the coil become substantially constant at all times. Therefore, even when a static displacement or a dynamic displacement is caused, the substantially same vibration reducing capacity as that of a case in which a static displacement or a dynamic displacement is not caused can be provided, and further control of the actuator can be easily performed.

Embodiment 3

In Embodiment 1, the direction of the central axis of the coil is made to agree with the elevating direction of the elevator car so that Lorentz's force can be generated in the elevating direction of the elevator car. On the other hand, in Embodiment 3, the direction of the central axis of the coil is made to be perpendicular to the elevating direction of the elevator car, so that Lorentz's force perpendicular to the elevating direction of the elevator car can be generated, and the drive of the guide lever is controlled by this force.

Figure 9:
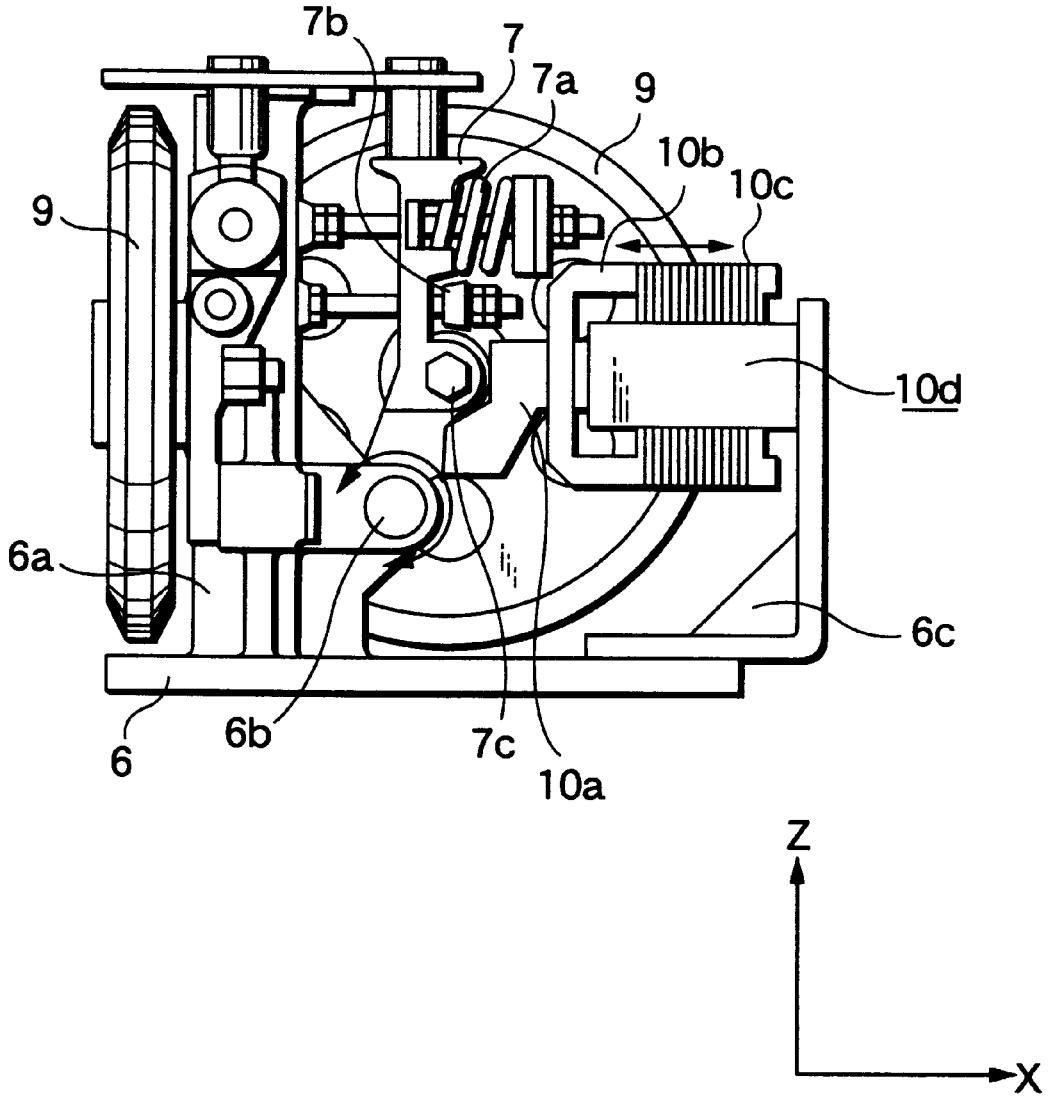
FIG. 9 is an overall arrangement side view showing an outline of a guide device of an elevator of Embodiment 3 of the present invention.

FIG. 9 is a side view showing a guide device of the elevator of Embodiment 3.

In the drawing, reference numeral 6*c* is an actuator fixing member fixed to the support base 6, extending from the support base 6 in the vertical direction (elevating direction), reference numeral 10*a* is an arm fixed to the guide lever 7, extending from the guide lever 7 in the vertical direction, reference numeral 10*b* is a bobbin fixed to the arm, and reference numeral 10*c* is a coil wound round the bobbin 10*b*. These arm 10*a*, bobbin 10*b* and coil 10*c* compose a movable section of the actuator 10 for the guide lever of the guide device.

Reference numeral 10*d* is a yoke fixed to the actuator fixing member 6*c*. As shown in FIGS. 3B, 4A and 4B, in this yoke 10*d*, there are provided two magnets 10*e* which are opposed to each other. The yoke 10*d* is arranged between the two magnets 10*e* leaving a predetermined distance. These yoke 10*d* and magnets 10*e* compose a stationary section of the actuator 10 for the arm of the guide device.

In the actuator shown in FIGS. 2, 3A and 3B, the coil in the movable section is driven in the vertical direction (elevating direction). On the other hand, in the actuator shown in FIG. 9, the coil in the movable section is driven in the horizontal direction. Except for that point, the actuator of this embodiment is the same as that of Embodiment 1. Therefore, explanations of this actuator will be omitted here.

In the elevator of this embodiment, the direction of the central axis of the coil is made to be perpendicular to the elevating direction of the elevator car, and Lorentz's force is generated in the perpendicular direction to the elevating direction of the elevator car, and the drive of guide lever is controlled by this force. Therefore, it is possible to control only the vibration in the side to side direction without giving a force in the front to back direction. Accordingly, in the case where there is a high correlation between the vibration in the front to back direction and the vibration in the side to side direction, even when the vibration in the side to side direction is suppressed, the vibration in the side to side direction, which is caused when a force is given in the front to back direction, is not caused. Therefore, the vibration in the side to side direction can be appropriately suppressed.

Embodiment 4

In Embodiment 1, the magnets are arranged so that the magnetic field can cover all the region in the axial direction of the coil in the coil oscillating region so that a region in which the coil is affected by the magnetic field of the magnets can become constant at all times. On the other hand, in this embodiment 4, the magnets are arranged so that all the magnetic field generated by the magnets can hit the coil at all times so that a region in which the coil receives the magnetic field of the magnets can be constant at all times.

Figure 10A:
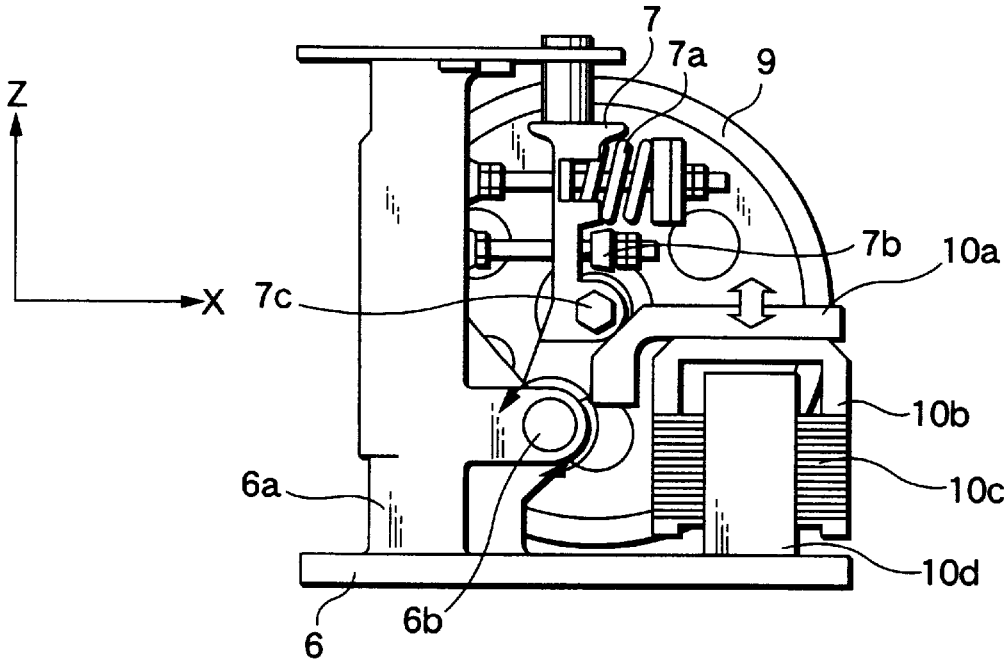
FIGS. 10A and 10B are overall arrangement side views showing an outline of a guide device of an elevator of Embodiment 4 of the present invention.
Figure 10B:
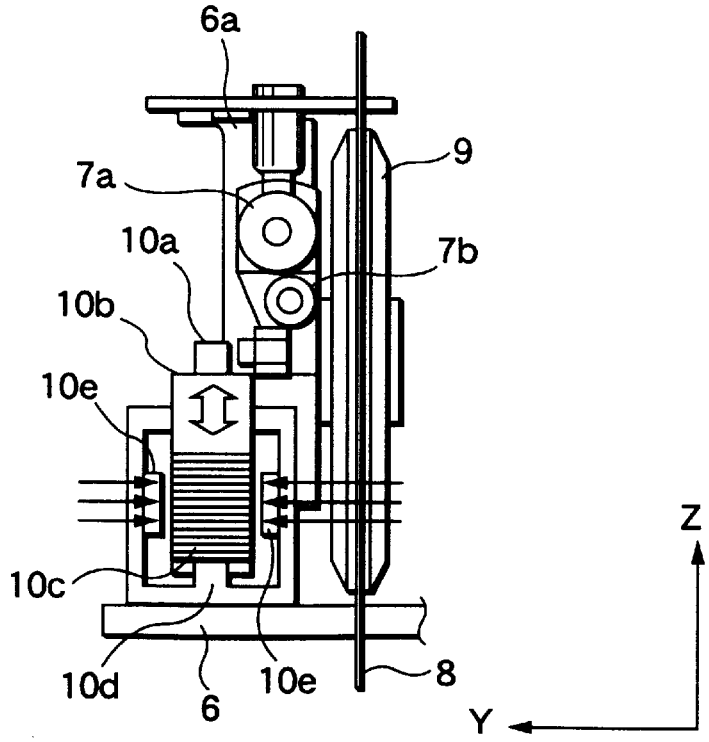
Figure 11A:
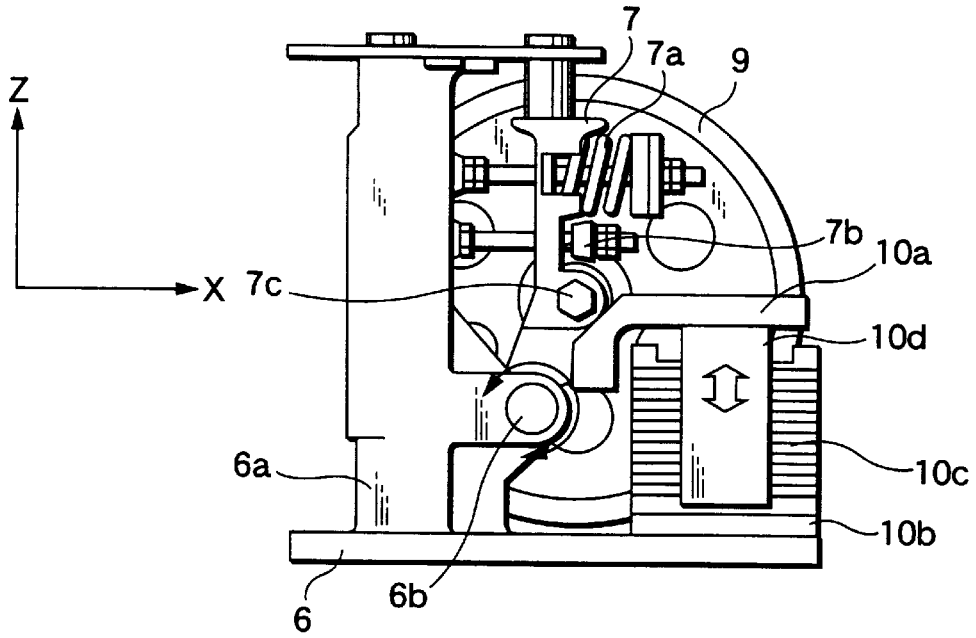
FIGS. 11A and 11B are overall arrangement side views showing an outline of a guide device of an elevator of Embodiment 4 of the present invention.
Figure 11B:
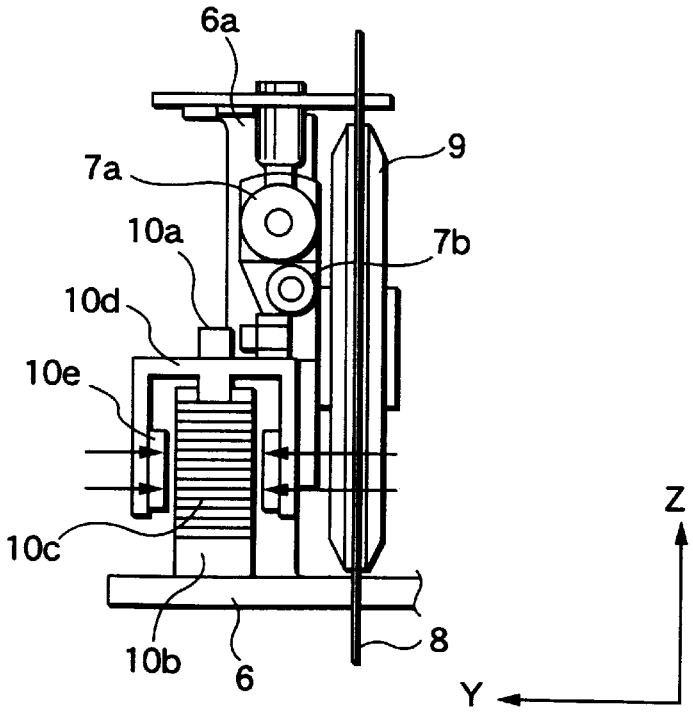

FIGS. 10A, 10B, 11A and 11B are side views showing a guide device of the elevator of Embodiment 4. FIGS. 10A and 10B are side views showing an arrangement in which the movable section of the actuator is composed of a coil (the stationary section is composed of a magnet). FIGS. 11A and 11B are side views showing an arrangement in which the movable section of the actuator is composed of a magnet (the stationary section is composed of a coil).

In FIGS. 10A and 10B, reference numeral 10*b* is a bobbin fixed onto the lower side of the arm, reference numeral 10*c* is a coil wound round the bobbin 10*b*, and reference numeral 10*d* is a yoke fixed to the support base 6. In this yoke, there are provided two magnets 10*e* which are opposed to each other. That is, the yoke 10*d* is arranged between the two magnets 10*e* leaving a predetermined distance. The magnets 10*e* are arranged so that the magnetic field can cover all the region of the coil 10*c* in the coil oscillating region so that a region in which the coil 10*c* is affected by the magnetic field of the magnets 10*e* can become constant at all times and all the magnetic field generated by the magnets 10*e* can hit the coil 10*c* at all times so that a region in which the coil receives the magnetic field of the magnets can be constant at all times.

In this connection, the actuator shown in FIGS. 10A and 10B is the same as the actuator shown in Embodiment 1 except for the relation between the coil and the magnets. Therefore explanations to the actuator will be omitted here. The actuator shown in FIGS. 11A and 11B is composed in such a manner that the movable section of the actuator shown in FIGS. 10A and 10B is composed of a magnet and the stationary section of the actuator shown in FIGS. 10A and 10B is composed of a coil, and the actuator shown in FIGS. 11A and 11B is the same as the actuator of Embodiment 2 except for the relation between the coil and the magnet. Therefore, explanations will be omitted here.

In the elevator of this embodiment, with respect to all the drive region of the guide lever, the area in which the coil and the magnetic field cross each other is made to be constant. Therefore, when the guide lever is driven, the force given to the coil from the magnetic field can be made to be constant. Accordingly, the actuator can be controlled more easily.

Embodiment 5

In Embodiment 1, the magnets are arranged so that the magnetic field can cross the moving plane of the guide lever. On the other hand, in this Embodiment 5, the magnets are arranged so that the magnetic field can be parallel with the moving plane of the guide lever.

Figure 12A:
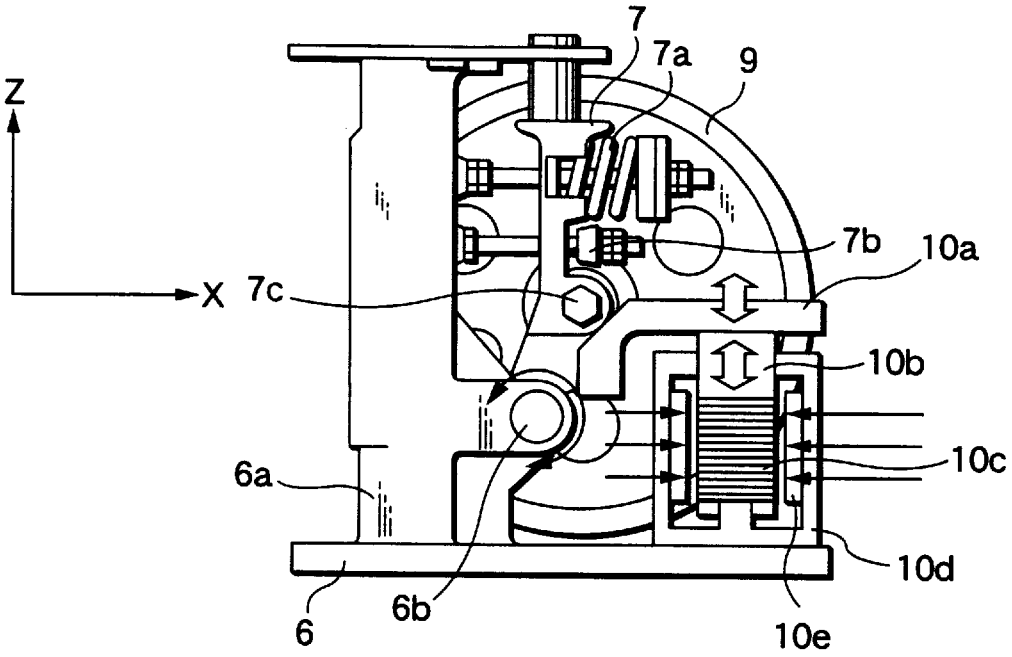
FIGS. 12A and 12B are overall arrangement side views showing an outline of a guide device of an elevator of Embodiment 5 of the present invention.
Figure 12B:
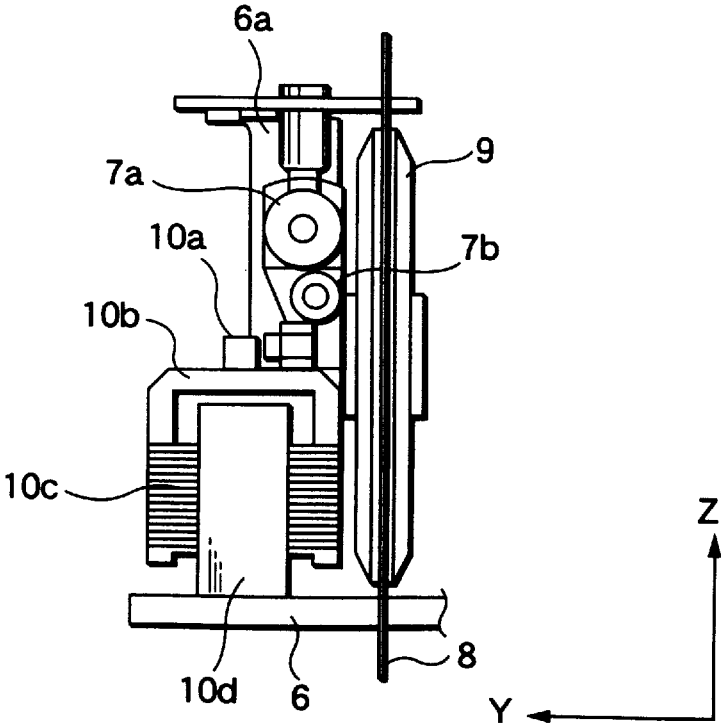
Figure 13:
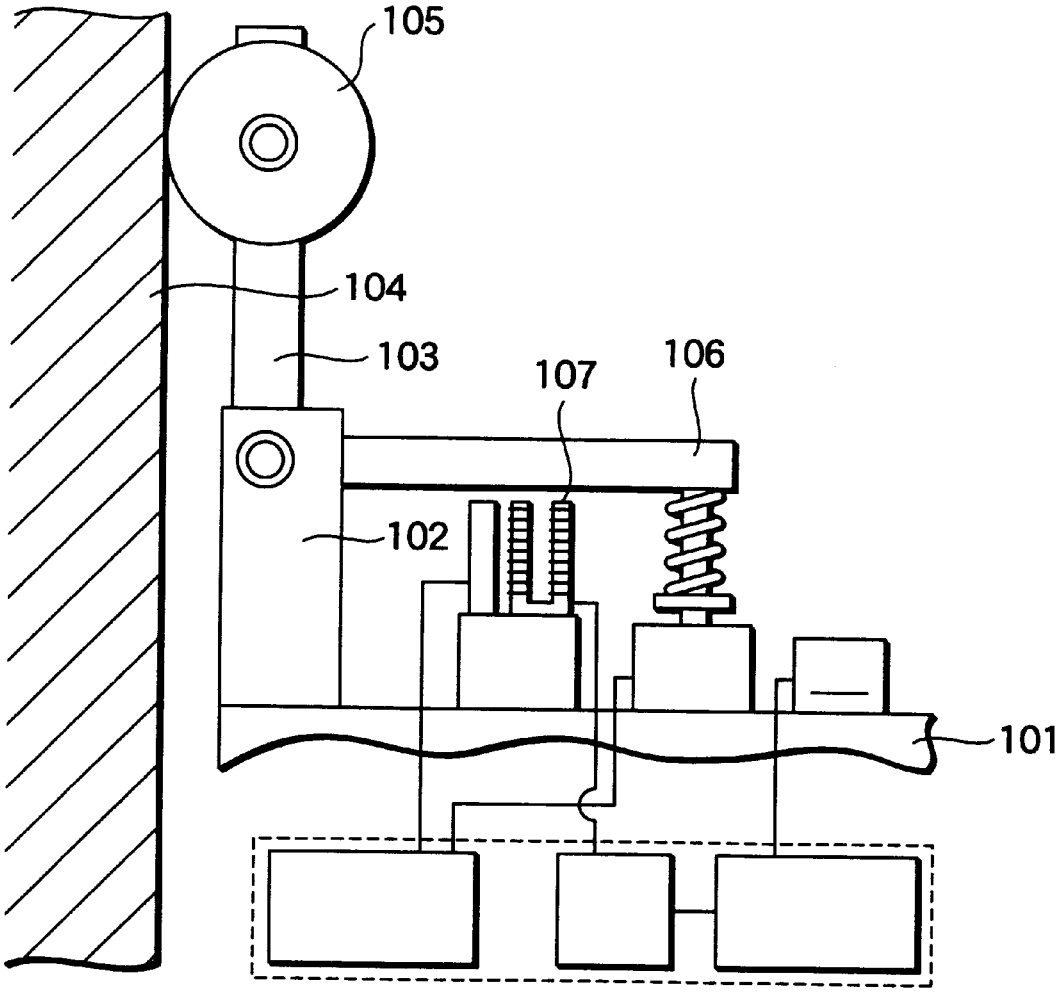
FIG. 13 is a side view showing a conventional elevator.

FIGS. 12A and 12B is a side view showing a guide device of the elevator of this embodiment. FIG. 12A is a side view showing an opposite side to the side on which a roller is attached, that is, FIG. 12A is a side view taken on the positive side in direction Y. FIG. 12B is a side view showing a side on which an actuator is provided, that is, FIG. 12B is a side view taken from the positive side of direction X. In the drawing, reference numeral 10*a* is an arm fixed to the guide lever 7 and extending from the guide lever 7 in the horizontal direction. Reference numeral 10*b* is a bobbin fixed to the lower side of the arm 10*a*. Reference numeral 10*c* is a coil wound round the bobbin 10*b*. These arm 10*a*, bobbin 10*b* and coil 10*c* compose a movable section of the actuator 10 for the guide lever of the guide device.

Reference numeral 10*d* is a yoke fixed to the support base 6. As shown in FIG. 12B, in this yoke 10*d*, there are provided two magnets 10*e* which are opposed to each other. The yoke 10*d* is arranged between the two magnets 10*e* leaving a predetermined distance. These yoke 10*d* and magnets 10*e* compose a stationary section of the actuator 10 for the guide lever of the guide device.

In this case, as shown in FIG. 12A, the magnet 10*e* is arranged so that a magnetic field parallel to the moving plane (plane XZ) of the guide lever 7 can be generated, and the coil 10*c* is arranged so that the axial center of the coil can be set in a direction perpendicular to this magnetic field. Other points of this embodiment is the same as those of Embodiment 1. Therefore, explanations will be omitted here.

When the magnet is arranged so that the direction of the magnetic field can be parallel to the moving plane, a change in the intensity of the magnetic field received by the coil with respect to a static and dynamic change in the case of a minute tilt of the coil is increased as compared with a case in which the magnet is arranged so that the magnetic field can be perpendicular to the moving plane, however, an area in which the coil and the magnet cross each other can be kept substantially constant with respect to the drive of the guide lever in a predetermined region. Therefore, intensities of the magnetic field round the coil become substantially constant at all times. Accordingly, even when a static or dynamic displacement is caused, it is possible to exhibit the substantially same vibration reducing capacity as that in the case where a static or dynamic displacement is not caused. Further, control can be easily performed.

The present invention provides an elevator comprising: an elevator car including a cage which runs in a hoistway along a pair of rails vertically arranged on side walls in the hoistway; and a plurality of guide devices for guiding the elevator car along with the pair of rails, attached onto the rail sides of the elevator car, each guide device including: a guide lever pivotally attached to a support member fixed to the elevator car or pivotally attached to the elevator car, so that the guide lever can be driven on a moving plane; a guide element for guiding the elevator car along the rail, being attached to the guide lever and coming into contact with the rail vertically arranged on the side wall of the hoistway; and an actuator device having a stationary actuator part fixed to the support member or the elevating member and also having a moving actuator part fixed to the guide lever and driven on the moving plane, wherein one of the moving actuator part and the stationary actuator part is a magnet for generating a magnetic field crossing a drive direction of the moving actuator part, the other of the moving actuator part and the stationary actuator part is a coil arranged so that the coil can be influenced by the magnetic field, and a Lorentz's force for driving the moving actuator part in the drive direction of the moving actuator part is generated by supplying an electric current in the coil when the elevator car is vibrating, so that the guide lever is driven by the Lorentz's force so as to suppress the vibration of the elevator car. Therefore, it is possible to provide an elevator having an actuator capable of generating a force perpendicular to the direction of the magnetic field, and the force constant (the ratio of a generated force to an electric current flowing in the coil) of the actuator seldom changes even when a static displacement is caused by an imbalance load of the cage or a dynamic displacement is caused in the case of driving.

When the magnet is arranged so that it can generate a magnetic field in a direction crossing the moving plane of the guide lever, even when a static displacement is caused by an imbalance load of the cage or a dynamic displacement is caused in the case of driving, the magnetic field received by the coil can be made to be substantially constant. Even in the case where a static or dynamic displacement is caused, the substantially same vibration reducing capacity as that of a case in which a static or dynamic displacement is not caused can be exhibited, and further the actuator can be easily controlled.

When the magnet is arranged so that it can generate a magnetic field in a direction perpendicular to the moving plane of the guide lever and the central axis of the coil is included on the moving plane of the guide lever, the guide lever is driven by the actuator only in the drive direction, that is, a redundant force is not given to the other direction. Therefore, the guide lever can be smoothly driven.

When the guide lever is driven in a predetermined region on the moving plane and an area in which the coil and the magnetic field cross each other becomes constant with respect to the drive of the guide lever in the predetermined region, even if the guide lever is driven, a force given to the coil by the magnetic field can be made constant. Even in the case where a static or dynamic displacement is caused, the substantially same vibration reducing capacity as that of a case in which a static or dynamic displacement is not caused can be exhibited, and further the actuator can be easily controlled.

When the magnet is arranged so that it can cover a region in which the coil is moved when the guide lever is driven, a constant intensity of magnetic field can be always given to the coil, and the coil is not affected by an external magnetic field.

When the magnet is composed of a pair of magnets arranged being opposed to each other with respect to the moving plane of the moving actuator part, and when a yoke member arranged at a predetermined distance from each magnet is provided between the pair of magnets, and also when the coil is arranged in such a manner that the coil surrounds the yoke member so that the yoke member and the coil can not be contacted with each other when the moving actuator part is driven, there is no possibility that the coil and the yoke are contacted with each other even if a static or dynamic displacement is caused.

The present invention provides a guide device for an elevator comprising: a guide lever attached to a support member fixed to an elevator car including a cage which runs in a hoistway along a pair of rails vertically arranged on side walls in the hoistway, the guide lever being driven on a moving plane; a guide element for guiding the elevator car along the rail, being attached to the guide lever and coming into contact with the rail vertically arranged on the side wall of the hoistway; and an actuator device having a stationary actuator part fixed to the support member and also having a moving actuator part fixed to the guide lever and driven on the moving plane, wherein one of the moving actuator part and the stationary actuator part is a magnet for generating a magnetic field crossing a drive direction of the moving actuator part, the other of the moving actuator part and the stationary actuator part is a coil arranged so that the coil can be influenced by the magnetic field, and a Lorentz's force for driving the moving actuator part in the drive direction of the moving actuator part is generated by supplying an electric current in the coil when the elevator car is vibrating, so that the guide lever is driven by the Lorentz's force so as to suppress the vibration of the elevator car. Therefore, it is possible to provide an elevator having an actuator capable of generating a force perpendicular to the direction of the magnetic field, and the force constant (the ratio of a generated force to an electric current flowing in the coil) of the actuator seldom changes even when a static displacement is caused by an imbalance load of the cage or a dynamic displacement is caused in the case of driving.

When the magnet is arranged so that it can generate a magnetic field in a direction crossing the moving plane of the guide lever, even in the case where a static or dynamic displacement is caused, the substantially same vibration reducing capacity as that of a case in which a static or dynamic displacement is not caused can be exhibited, and further the actuator can be easily controlled.

When the guide lever is driven in a predetermined region on the moving plane and an area in which the coil and the magnetic field cross each other becomes constant with respect to the drive of the guide lever in the predetermined region, even if the guide lever is driven, a force given to the coil by the magnetic field can be made constant. Even in the case where a static or dynamic displacement is caused, the substantially same vibration reducing capacity as that of a case in which a static or dynamic displacement is not caused can be exhibited, and further the actuator can be easily controlled.

What is claimed is:

1. An elevator comprising:

a pair of rails vertically arranged on side walls in a hoistway;

an elevator car including a cage which runs in the hoistway along the pair of rails; and a plurality of guide devices for guiding the elevator car along the pair of rails, the plurality of guide devices contacting sides of the pair of rails, wherein each of the plurality of guide devices includes:

a guide lever pivotally attached to a support member fixed to the elevator car, so that the guide lever may be driven in a plane;

a guide element for guiding the elevator car along the rail, the guide element being attached to the guide lever and contacting one of the rails; and an actuator device having a stationary actuator part fixed to the support member, and a moving actuator part fixed to the guide lever and driven in the plane, wherein one of the moving actuator part and the stationary actuator part is a magnet generating a magnetic field crossing a drive direction of the moving actuator part, the other of the moving actuator part and the stationary actuator part is a coil, wherein a Lorentz force is generated by interaction of the magnetic field and supplying of an electric current to the coil when the elevator car is vibrating, so that the guide lever is driven by the Lorentz force to suppress vibration of the elevator car.

2. The elevator according to claim 1, wherein the magnet generates a magnetic field in a direction crossing the plane in which the guide lever is driven.

3. The elevator according to claim 2, wherein the magnet generates a magnetic field in a direction perpendicular to the plane in which the guide lever is driven, and the coil has a central axis in the plane.

4. The elevator according to claim 1, wherein the guide lever is driven in a region of the plane, and an area in which the coil and the magnetic field cross each other becomes constant with respect to movement of the guide lever in the region.

5. The elevator according to claim 1, wherein the magnet covers a second region in which the coil is moved when the guide lever is driven.

6. The elevator according to claim 1, wherein the magnet includes:

a pair of magnets opposite to each other with respect to the plane; and a yoke member located at a distance from each magnet, between the pair of magnets, wherein the coil surrounds the yoke member and the yoke member and the coil do not contact each other when the moving actuator part is driven.

7. A guide device for an elevator comprising:

a guide lever attached to a support member fixed to an elevator car including a cage which runs in a hoistway along a pair of rails vertically arranged on side walls in the hoistway, the guide lever being driven in a plane;

a guide element for guiding the elevator car along one of the rails, the guide element being attached to the guide lever and contacting one of the rails; and an actuator device having a stationary actuator part fixed to the support member and a moving actuator part fixed to the guide lever and driven in the plane, wherein one of the moving actuator part and the stationary actuator part is a magnet generating a magnetic field crossing a drive direction of the moving actuator part, and the other of the moving actuator part and the stationary actuator part is a coil, wherein a Lorentz force is generated by interaction of the magnetic field and supplying of an electric current to the coil when the elevator car is vibrating, so that the guide lever is driven by the Lorentz force to suppress vibration of the elevator car.

8. The guide device for an elevator according to claim 7, wherein the magnet generates a magnetic field in a direction crossing the plane in which the guide lever is driven.

9. The guide device for an elevator according to claim 7, wherein the guide lever is driven in a region of the plane, and an area in which the coil and the magnetic field cross each other becomes constant with respect to movement of the guide lever in the region.

10. An elevator comprising:

a pair of rails vertically arranged on side walls in a hoistway;

an elevator car including a cage which runs in the hoistway along the pair of rails; and a plurality of guide devices for guiding the elevator car along the pair of rails, the plurality of guide devices contacting sides of the pair of rails, wherein each of the plurality of guide devices includes:

a guide lever pivotally attached to the elevator car, so that the guide lever may be driven in a plane;

a guide element for guiding the elevator car along the rail, the guide element being attached to the guide lever and contacting one of the rails; and an actuator device having a stationary actuator part fixed to the elevator car; and a moving actuator part fixed to the guide lever and driven in the plane, wherein one of the moving actuator part and the stationary actuator part is a magnet generating a magnetic field crossing a drive direction of the moving actuator part, and the other of the moving actuator part and the stationary actuator part is a coil, wherein a Lorentz force is generated by interaction of the magnetic field and supplying of an electric current to the coil when the elevator car is vibrating, so that the guide lever is driven by the Lorentz force to suppress vibration of the elevator car.

11. The elevator according to claim 10, wherein the magnet generates a magnetic field in a direction crossing the plane in which the guide lever is driven.

12. The elevator according to claim 11, wherein the magnet generates a magnetic field in a direction perpendicular to the plane in which the guide lever is driven, and the coil has a central axis in the plane.

13. The elevator according to claim 10, wherein the guide lever is driven in a region of the plane, and an area in which the coil and the magnetic field cross each other becomes constant with respect to movement of the guide lever in the region.

14. The elevator according to claim 10, wherein the magnet covers a second region in which the coil is moved when the guide lever is driven.

15. The elevator according to claim 10, wherein the magnet includes:

a pair of magnets opposite to each other with respect to the plane; and a yoke member located at a distance from each magnet, between the pair of magnets, wherein the coil surrounds the yoke member and the yoke member and the coil do not contact each other when the moving actuator part is driven.

* * * * *